US005377666A

United States Patent [19]

Whitehouse

[11] Patent Number: 5,377,666

[45] **Date of Patent: * Jan. 3, 1995**

[54] METHOD AND APPARATUS FOR USE IN INSTALLING A FIRE IN A FIREPLACE IN CONNECTION WITH A FLUE LINER

[75] Inventor: Donald Whitehouse, Birmingham, England

[73] Assignee: Valor Limited, Erdington, England

[ * ] Notice: The portion of the term of this patent subsequent to Nov. 23, 2010 has been disclaimed.

[21] Appl. No.: 107,289

[22] Filed: Aug. 16, 1993

Related U.S. Application Data

[63] Continuation of Ser. No. 918,418, Jul. 22, 1992, Pat. No. 5,263,470.

[51] Int. Cl.[6] ..... F24C 15/30

[52] U.S. Cl. ..... 126/500; 126/315; 126/318

[58] Field of Search ..... 126/315, 500, 316, 318, 126/82, 307 R, 307 A, 85 R, 312

[56] References Cited

U.S. PATENT DOCUMENTS

| | | | |
|---|---|---|---|
| 1,278,895 | 9/1918 | Farley | 126/315 |
| 4,766,882 | 8/1988 | Schinbeckler | 126/500 |
| 4,924,850 | 5/1990 | Rieger | 126/315 |
| 5,263,470 | 11/1993 | Whitehouse | 126/500 |

*Primary Examiner*—James C. Yeung

*Attorney, Agent, or Firm*—Bernard L. Kleinke; Jerry R. Potts

[57] ABSTRACT

The present invention relates to a method and apparatus for use in installing a gas fire in a fireplace. The apparatus comprises an adaptor member in the form of a planar plate from which a flue spigot projects upwardly, the flue spigot in use, being connected with a flue liner. The planar plate has a rearward end section which is interengageable with a rearward part of the fire whereby the planar plate can subsequently be pivoted to a position wherein a front section of the planar plate can be secured to the fire. Said rearward end section and said front section of the planar plate are thus secured to the fire, holding the planar adaptor member flat against the upper surface of the fire with the flue spigot aligned with a flue passage in the fire.

2 Claims, 3 Drawing Sheets

METHOD AND APPARATUS FOR USE IN INSTALLING A FIRE IN A FIREPLACE IN CONNECTION WITH A FLUE LINER

This is a continuation, of application Ser. No. 07/918,418, filed on Jul. 22, 1992, now U.S. Pat. No. 5,263,470.

The present invention relates to a method and apparatus for use in installing a firebox in a fireplace in connection with a flue liner.

In particular the present invention relates to a method and apparatus for use in installing a gas firebox in a fireplace. Certain known gas firebox have a flue spigot which projects generally upwardly from the rear region of the upper surface of the gas firebox. During installation the gas fireboxes is moved rearwardly into the fireplace until the flue spigot is nearly underneath the flue liner which extends up the flue/chimney. The flue liner is then flexed and/or moved generally vertically and located over the flue spigot and a clamp such as a jubilee clip is used to tighten the liner around the spigot. The gas firebox can then be moved the final small distance to the fully installed position. As will be appreciated there must be a considerable amount of space available between at least the upper surface of the gas firebox and the top of the fireplace opening to both allow the upstanding spigot to move with the gas firebox into the fireplace opening and to allow the arms and hands of the person installing the firebox to reach the spigot to make and tighten the connection between the spigot and liner. Such a large clearance has to be aesthetically closed in the completed installation and sometimes the size of the gas firebox is optimised requiring the gas firebox to be a relatively close fit in the fireplace opening. In the latter case an adaptor such as disclosed in U.S. Pat. No. 4,924,850 can be used to simplify the connection with the flue liner. The adaptor of U.S. Pat. No. 4,924,850 comprises a generally rectangular planar plate from one end region of which a cylindrical flue spigot projects. In use the spigot is first secured to the flue liner and then as the firebox is introduced into the fireplace opening and moved rearwardly, the planar plate is engaged in and slid along elongate guides provided in the upper surface of the firebox. When the gas firebox attains its fully installed position the planar plate or a projection thereof can be secured to the body of the gas firebox, the spigot then being aligned with a flue passage in the gas firebox, which flue passage opens in the upper surface of the firebox between said elongate guides. Due to manufacturing tolerances the planar plate can be a relatively loose fit in the elongate guides and thus combusted gases may be able to escape into the fireplace opening and thus through the front of the firebox, rather than pass into the flue liner. Also during installation, the planar plate may become angled to the elongate guides and jammed in the guides, thus hampering and delaying the completion of installation.

The aim of the present invention is to provide an improved method and apparatus for installing a firebox in a fireplace opening, which provides a close fit with the body of the gas fire whereby the firebox can be simply though efficiently connected with a flue liner.

According to the present invention there is provided an apparatus for use in installing a fire in a fireplace opening comprising an adaptor, part of which forms a flue spigot which, in use, can be connected with a flue liner, the adaptor member having a section which is engageable with part of the body of a firebox whereby the adaptor can be subsequently pivoted to a position wherein the adaptor member can be secured flat against the upper surface of the firebox with the flue spigot aligned with a flue passage in the body of the firebox.

In a preferred embodiment of the present invention the adaptor member comprises a rectangular planar plate with a cylindrical flue spigot projecting upwardly therefrom. In use the flue spigot is secured to a flue liner by a clamp such as a jubilee clip. The gas firebox is then located in the fireplace opening and moved rearwardly until the spigot of the adaptor member is substantially over a flue passage in the body of the gas firebox, the adaptor member and flue liner being pushed upwards slightly to allow the firebox to enter the fireplace opening easily. By pulling the adaptor member downwards and forwards, and tilting the planar plate, a section of the adaptor member in the form of a tongue provided on the rear end edge region of the planar plate, can be engaged in an opening in an upstanding flange provided at the rear of the upper surface of the body of the firebox. The planar plate is then effectively pivoted down into engagement with the upper surface of the body of the firebox, the tongue and aperture being preferably tapered to hold the rear end region of the adaptor member in this position. The other end region of the planar plate can then be secured, e.g. screwed, to the front region of the upper surface of the gas firebox, thus securing the planar plate tightly and closely to the upper surface of the firebox. If required a gasket may be provided between the planar plate and the upper surface of the gas firebox around the aligned flue passage/flue spigot connection to further seal the planar plate to the upper surface of the firebox. Thus a simple positive connection is achieved.

As opposed to providing the tongue in the planar plate and an aperture in a flange of the gas fire box, the converse or any other suitable male/female interconnection may be provided between the rear end region of the adaptor member and the gas fire body. For example, the rear end region of the planar plate may have a downwardly and forwardly projecting tongue which can be engaged in an aperture in the rear face of the gas firebox.

According to a further aspect of the present invention there is provided a method of installing a firebox in a fireplace opening comprising the steps of providing an adaptor member, part of which takes the form of a flue spigot, connecting the flue spigot with a flue liner, locating the firebox in a position wherein a flue passage opening in the upper surface of the gas firebox is located generally under the flue spigot, moving the adaptor member towards the front of the firebox and engaging a rearward part of the adaptor member with part of the body of the fire, effectively pivoting the adaptor member to a position wherein the adaptor member is flat against the upper surface of the fire with the flue spigot aligned with the flue passage, and securing the forward region of the adaptor member to the body of the fire. If required a gasket may be provided between the adaptor member and the upper surface of the firebody to further seal the adaptor member to the body of the firebox to ensure that all of the combusted gases flowing along the flue passage enter the flue liner.

The present invention will now be further described, by way of example, with reference to the accompanying drawings, in which.

Figure 1:
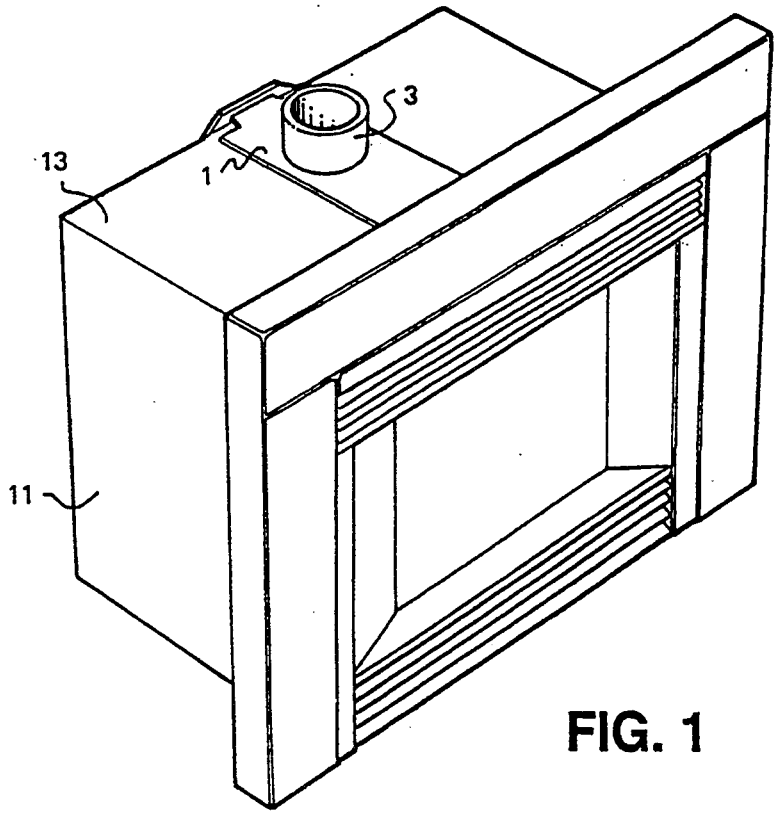
FIG. 1 is a perspective view of a firebox suitable for incorporating the apparatus of the present invention.
Figure 2:
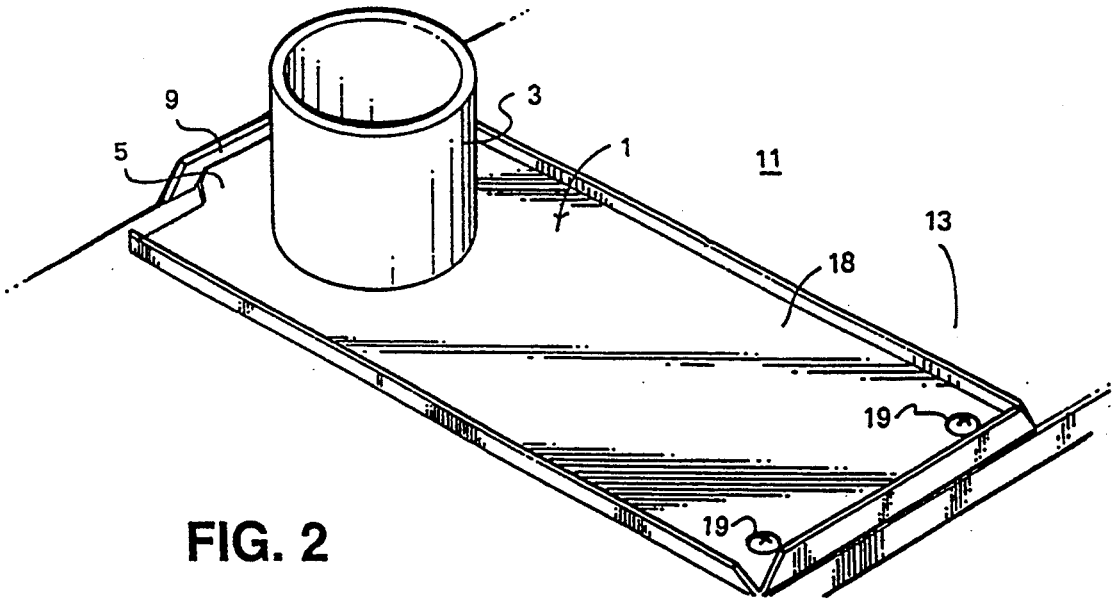
FIG. 2 is an enlarged perspective view of part of the upper surface of the firebox of FIG. 1, incorporating one embodiment of the present invention.

A preferred embodiment of the present invention is illustrated in the accompanying drawings, and comprises an adaptor member in the form of a planar plate 1 of generally rectangular configuration. A cylindrical flue spigot 3 projects upwardly from one end region of the planar plate 1, and opens through the planar plate 1. The end edge section of the planar plate 1 nearest to the flue spigot 3 is formed as a tongue 5—see FIG. 3,—which can be engaged in a slot 7 formed by an upstanding flange 9 provided at the rear of a gas fire body or firebox 11, the lower edge of the slot 7 being formed by the upper surface 13 of the gas fire body.

Figure 3:
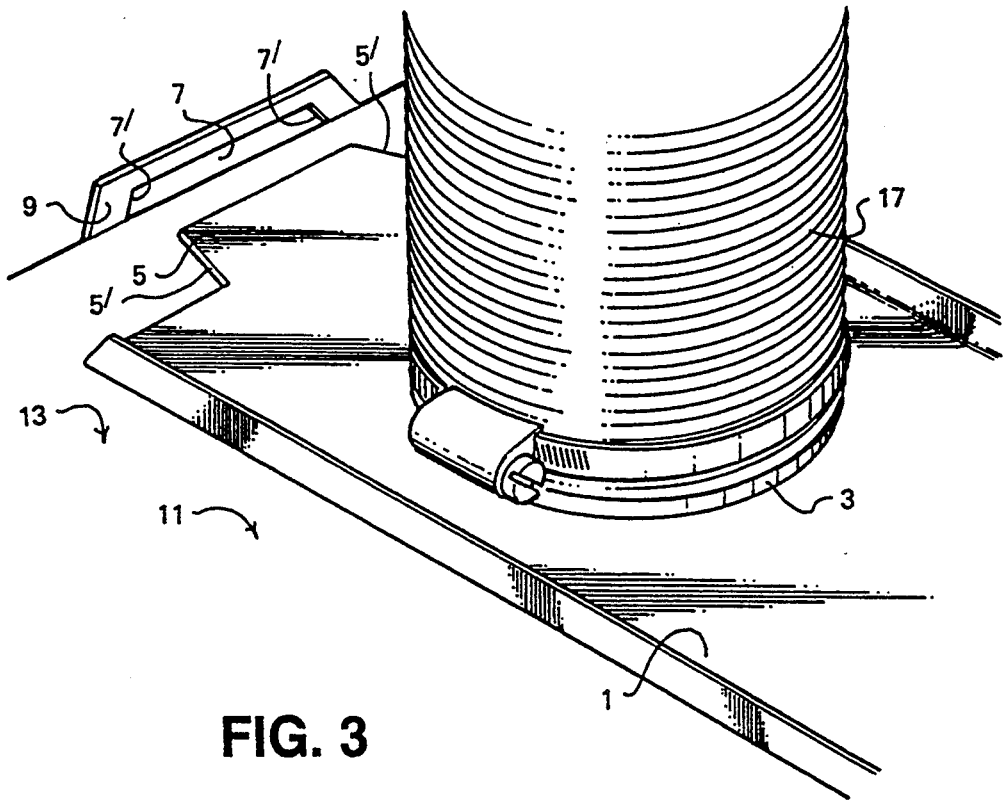
FIG. 3 is a further enlarged view of part of the upper surface shown in FIG. 2, illustrating the assembly of the apparatus of the present invention.
Figure 4:
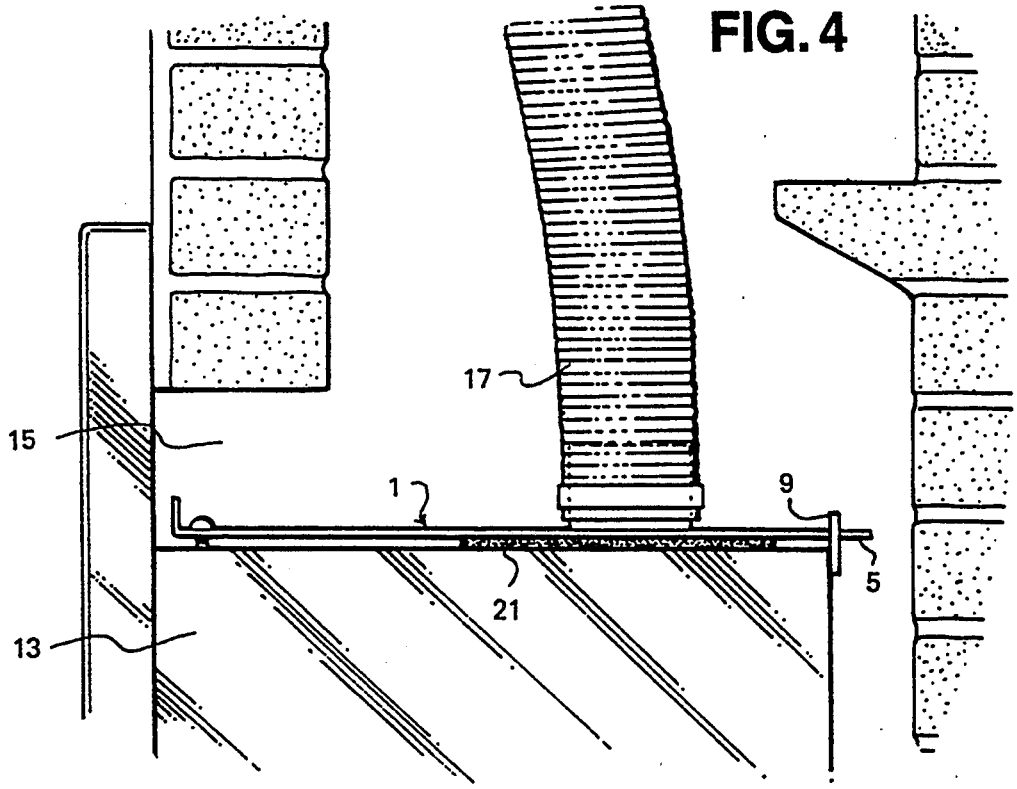
FIG. 4 is a schematic cross-sectional view of the firebox of FIGS. 1 and 2, installed in a fireplace opening and connected with a flue liner.

In use, as best seen in FIG. 4, the adaptor member 1 is first located in a fireplace opening 15 with the flue spigot 3 located over and secured to the end region of a flue liner 17. The gas fire body 11 is then moved rearwardly into the fireplace opening 15, the flue liner 17 usually being flexible and having a limited amount of vertical movement available so that the adaptor member 1 can be pushed clear of the upstanding flange 9 at the rear of the gas fire body 11. With the gas fire body 11 virtually in the fully installed position, the planar plate 1 can be manually pulled from its other end edge region 18 which is adjacent the front of the fire body 11, so that the tongue 5 is located in front of the upstanding flange 9. With the planar plate 1 tilted slightly the tongue 5 can be slid along the upper surface 13 of the gas fire body 11 into the slot 7. Then the planar plate 1 can be pivoted downwards to lie flush along the upper surface 13 of the gas fire body. As best seen in FIG. 3 the tongue 5 has tapered side edges 5' and the slot 7 has tapered side edges 7' which interengage to force the tongue 5 and thus the planar plate 1 down against the upper surface 13 of the gas fire body 11, with the spigot 3 and thus the flue liner 17, coaxially aligned with the flue passage in the gas fire body 11. The planar plate 1 is secured in this gas-tight manner by the other end edge region of the planar plate 1, which is near to the front of the fire body 11, being secured to the gas fire body 11 by screws 19 which can be readily located and tightened from the front of the fire body 11.

To ensure a gas-tight seal between the planar plate 1 and the upper surface 13 around the aligned flue liner 17 and the flue passage in the gas fire body 11, a gasket 21 can be provided between the planar plate 1 and upper surface 13. In such a case the bottom edge of the slot 7 need not be flush with the upper surface 13.

Figure 5A:
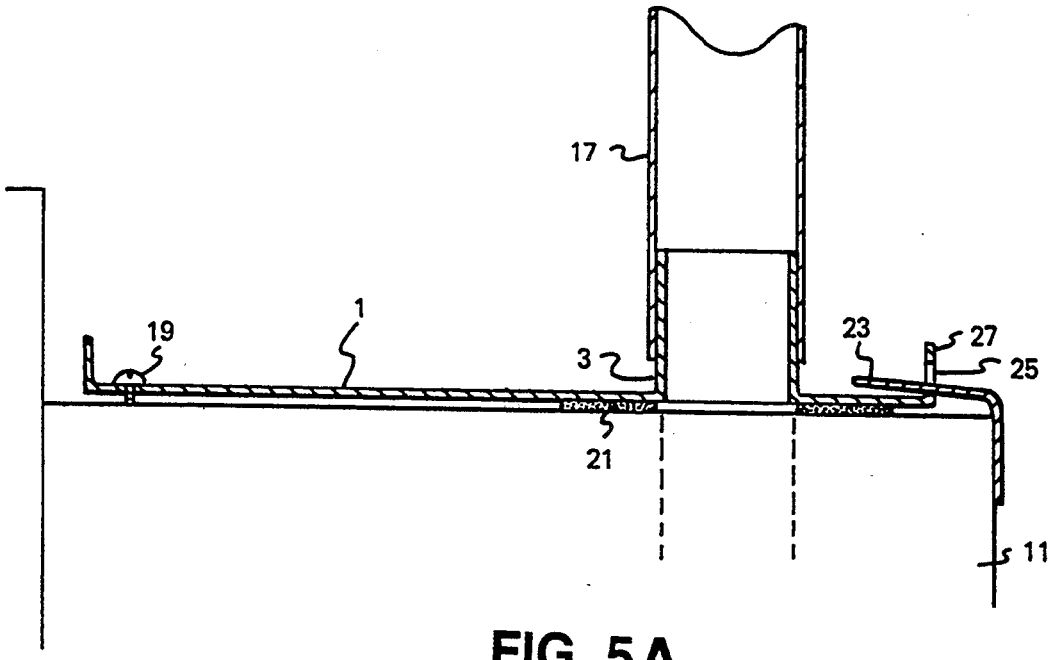
FIG. 5A is a side view of a further embodiment of the present invention.
Figure 5B:
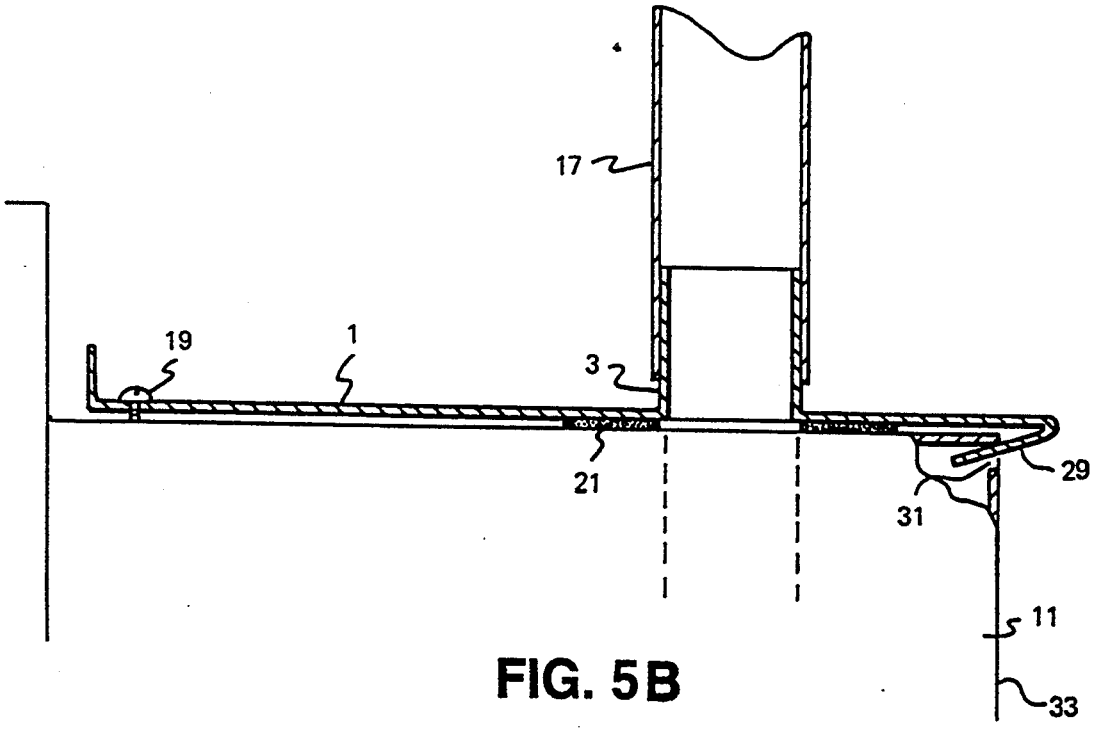
FIG. 5B is a side view of a still further embodiment of the present invention.

In a modified embodiment of the present invention, as shown in FIG. 5A of the accompanying drawings, a tongue 23 projects from the rear region of the gas fire body 11, and a complementary slot 25 is provided in an upstanding flange 27 of the planar plate 1. Otherwise this modified embodiment functions exactly as for the embodiment of FIGS. 1 to 4, described hereabove.

In a still further embodiment of the present invention the rear edge of the planar plate 1 is provided with a downwardly and forwardly projecting tongue 29 which, in use, engages in an aperture 31 provided in the rear face 33 of the gas fire body 11. To hold the rear end region of the planar plate 1 against the upper surface 13 of the gas fire body 11 the tongue 29 is angled so that the further it engages in the aperture 31 the tighter the planar plate engages the surface 13 or gasket 21.

As an alternative to the above described planar plate, planar tongue and slot configurations, the adaptor member can have any desired configuration, with any required male/female interengaging connection being provided to the rear of the upper part of the gas fire body.

The present invention thus provides a simple but efficient apparatus and method for use in connecting a gas fire body 11 to a flue liner, the apparatus being simply and positively installable without the possibility of the adaptor becoming jammed.

I claim:

1. Apparatus for use in installing a firebox in a fireplace opening, said fireplace having a flue liner and said firebox having a front part, a rear part including firebox engagement means for helping to secure the apparatus to the firebox and an upper surface with a flue passage disposed therein, comprising:

an adaptor member for helping to facilitate installation of the firebox in the fireplace, said adaptor member having a flue spigot adapted to be connected with the flue liner;

said adaptor member having adaptor engagement means disposed on one side of said flue spigot for interengagement with the firebox engagement means of the rear part of the firebox to help secure the apparatus to the firebox;

said adaptor member having adaptor securing means for helping to fasten said adaptor member to the upper surface of the firebox disposed on another side of said flue spigot opposite of said adaptor engagement means for facilitating securing the adaptor member to the upper surface of the firebox; and said adaptor member having its adaptor engagement means for interengaging with the firebox engagement means to enable said adaptor member to be moved over the upper surface of the firebox in a slightly upwardly tilted position into engagement with the firebox engagement means and to be then pivoted downwardly until the adaptor member lies flush against the upper surface of the firebox to enable said adaptor member to be secured to the firebox;

whereby the firebox engagement means and the adaptor engagement means cooperate together to help hold the adaptor member flat against the upper surface of the firebox with the flue spigot aligned with the flue passage in the firebox.

2. An apparatus for use in a fireplace, said fireplace having a flue, a flue liner and a firebox with an upper surface having means defining a flue passage opening disposed therein, comprising:

an adaptor member having one end edge at a front portion thereof and a flue spigot portion near another end edge thereof, said flue spigot portion being connectable to the flue liner;

means defining a slot on one of the firebox and said adaptor member;

tongue means being disposed on the other one of the firebox and said adaptor member and being dimensioned to be received within the slot when angularly disposed relative to the upper surface of the firebox and adapted to be interengageable with said slot when disposed in alignment with the upper surface of the firebox;

said slot enabling said tongue means to be received initially within said slot at a slightly tilted approach and to be received thereafter in a downwardly pivoted position in said alignment with the firebox upper surface;

said tongue means helping to retain fixedly said adaptor member in a flush position on the upper surface of the firebox and helping to align coaxially said flue spigot with said flue passage opening; and whereby the adaptor member can be pivoted within said means defining a slot to force said adaptor member flat against the upper surface of the firebox with the flue spigot aligned with the flue passage in the firebox.

* * * * *

UNITED STATES PATENT AND TRADEMARK OFFICE

CERTIFICATE OF CORRECTION

PATENT NO. : 5,377,666

DATED : January 3, 1995

INVENTOR(S) : Donald Whitehouse

It is certified that error appears in the above-indentified patent and that said Letters Patent is hereby corrected as shown below:

On the face page, item [54], after "installing a", delete "fire", and substitute therefor — firebox —.

Signed and Sealed this

Twenty-seventh Day of June, 1995

*Attest:*

Bruce Lehman

BRUCE LEHMAN

*Attesting Officer*

*Commissioner of Patents and Trademarks*